US006685344B1

(12) United States Patent
Lin

(10) Patent No.: US 6,685,344 B1
(45) Date of Patent: Feb. 3, 2004

(54) LAMP SHADE ASSEMBLY

(76) Inventor: William K. Lin, 4th Fl., No. 1, Lane 9, Ming Sheng East Road, Sec. 3, Taipei (TW)

( * ) Notice: Subject to any disclaimer, the term of this patent is extended or adjusted under 35 U.S.C. 154(b) by 0 days.

(21) Appl. No.: 10/274,699

(22) Filed: Oct. 18, 2002

(51) Int. Cl.[7] ..... F21V 1/06

(52) U.S. Cl. ..... 362/352; 362/357; 362/358; 362/355; 362/356; 362/360; 362/361; 362/450

(58) Field of Search ..... 362/352, 357, 362/358, 450, 355, 356, 360, 361

(56) References Cited

U.S. PATENT DOCUMENTS 6,540,383 B2 * 4/2003 Wu ..... 362/450
2002/0118543 A1 * 8/2002 Wu ..... 362/358

* cited by examiner

*Primary Examiner*—Sandra O'Shea
*Assistant Examiner*—Mark Tsidulko
(74) *Attorney, Agent, or Firm*—Raymond Y. Chan; David and Raymond Patent Group

(57) ABSTRACT

A lamp shade assembly includes a foldable shade having an upper edge and a lower edge to define an inner cavity therebetween, a top frame mounted at the upper edge of the foldable shade, a bottom frame mounted at the lower edge of the foldable shade, and a supporting frame detachably mounted between the top frame and the bottom frame within the inner cavity of the foldable shade for applying a stretching force on the foldable shade. The stretching force of the supporting frame is greater than a weight of the foldable shade, so that the foldable shade is stretched to provide a tension surface extending between the upper edge and the lower edge thereof, so as to form a collapsible lamp shade which is facilitated to be disassembled into a compact unit for storage and carriage and quickly assembled to tensely support a foldable shade.

7 Claims, 4 Drawing Sheets

LAMP SHADE ASSEMBLY

BACKGROUND OF THE PRESENT INVENTION

1. Field of Invention

The present invention relates to a light apparatus, and more particularly to a lamp shade assembly which is facilitated to be disassembled into a compact unit for storage and carriage and assembled to tensely support a foldable shade.

2. Description of Related Arts

Lamps are common used not only for lighting up the house but also as a decoration for enhancing an aesthetically appealing in the house since the lamps are easy to set up and can be placed anywhere in the house, such as on a side table. A conventional lamp comprises a lamp stand, a lamp shade assembly supported on the stand, and a lighting element disposed in the lamp shade assembly.

Accordingly, the lamp shade assembly comprises a supporting frame attached to the lamp stand and a foldable shade encirclingly mounted around the supporting frame in such a manner that the light from the lighting element is softened by the foldable shade to create an aesthetical lighting effect and please the people's eye.

However, the conventional lamp shade assembly has several drawbacks. Since the lamp is already assembled during manufacturing, the size of the lamp is relatively large that is difficult for packaging and shipping. Even though the lamp shade assembly can be detached from the lamp stand to reduce the size of the lamp, it is always a headache for the manufacturer to pack the lamp shade assembly. Since the supporting frame is mainly for supporting the foldable shade, the structure of the supporting frame will not be designed as rigid as to support the weight of the lamp, such that any mistake may not only bend or even break the supporting frame but also tear off the foldable shade.

An improved lamp shade assembly provides an assemble feature of the supporting frame wherein the supporting frame is capable of disassembling into several parts for packaging purpose and assembling back for displaying purpose. However, the user must use a tool such as a screw or bolt to assemble the lamp shade assembly to retain the supporting frame. In addition, after assembling the lamp shade assembly, the supporting frame may not well support the foldable shade in a tension manner. Therefore, even though the lamp shade assembly can be disassembled into a compact size for storage and carriage, the wrinkly foldable shade supported by the supporting frame will down grade the overall appearance of the lamp.

SUMMARY OF THE PRESENT INVENTION

A main object of the present invention is to provide a lamp shade assembly, wherein a top frame and a bottom frame are securely attached to an upper edge and a lower edge of the foldable shade respectively and a supporting frame is detachably connected between the top and bottom frame to apply a stretching force on the foldable shade so as to tensely support the foldable shade to form a lamp shade.

Another object of the present invention is to provide a lamp shade assembly which is facilitated to be disassembled into a compact unit for storage and carriage and quickly assembled to tensely support a foldable shade. In other words, the lamp shade assembly can be folded up by minimizing a distance between the top and bottom frames so as to substantially reduce the size of the lamp shade assembly for packaging purpose.

Another object of the present invention is to provide a lamp shade assembly, wherein the supporting frame is interlocked with the top frame such that the supporting frame is securely locked between the top and bottom frames to tensely support the foldable shade to form the lamp shade.

Another object of the present invention is to provide a lamp shade assembly, wherein the attachment of the supporting with the upper and lower frames is easy and fast, that is simply by inserting the bottom ends of the supporting into the attachment sockets provided at the bottom frame and clip the upper end of the supporting frame with the top frame.

Another object of the present invention is to provide a lamp shade assembly, wherein the assembling and disassembling operations of the lamp shade assembly do not require any tools, so as to minimize the necessary parts of the lamp shade assembly.

Another object of the present invention is to provide a lamp shade assembly, which has a simple construction that every individual is able to assemble and disassemble the lamp shade assembly in seconds.

Accordingly, in order to accomplish the above objects, the present invention provides a lamp shade assembly, comprising:

- a foldable shade having an upper edge and a lower edge to define an inner cavity therebetween;
- a top frame mounted at the upper edge of the foldable shade;
- a bottom frame mounted at the lower edge of the foldable shade; and
- a supporting frame detachably mounted between the top frame and the bottom frame within the inner cavity of the foldable shade for applying a stretching force on the foldable shade, wherein the stretching force of the supporting frame is greater than a weight of the foldable shade so that the foldable shade is stretched to provide a tension surface extending between the upper edge and the lower edge thereof.

DETAILED DESCRIPTION OF THE PREFERRED EMBODIMENT

Figure 1:
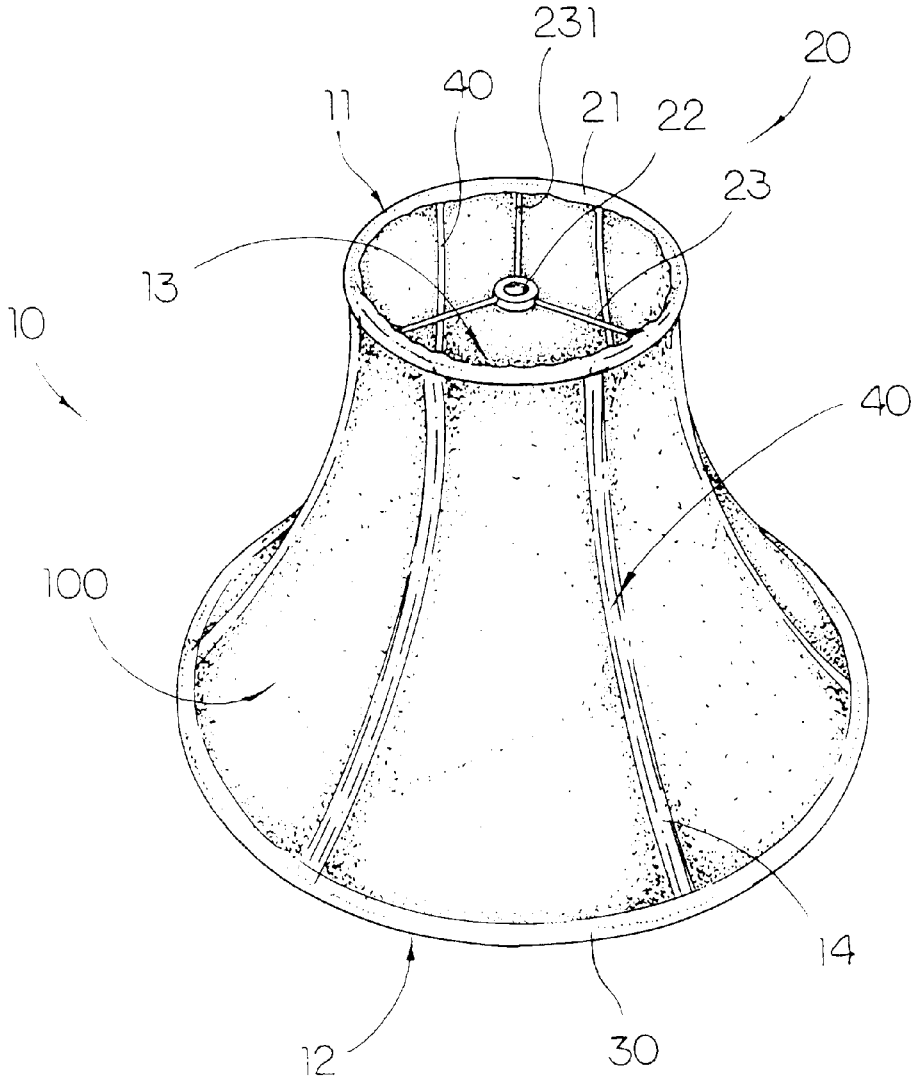
FIG. 1 is a perspective view of a lamp shade assembly according to a preferred embodiment of the present invention.
Figure 2:
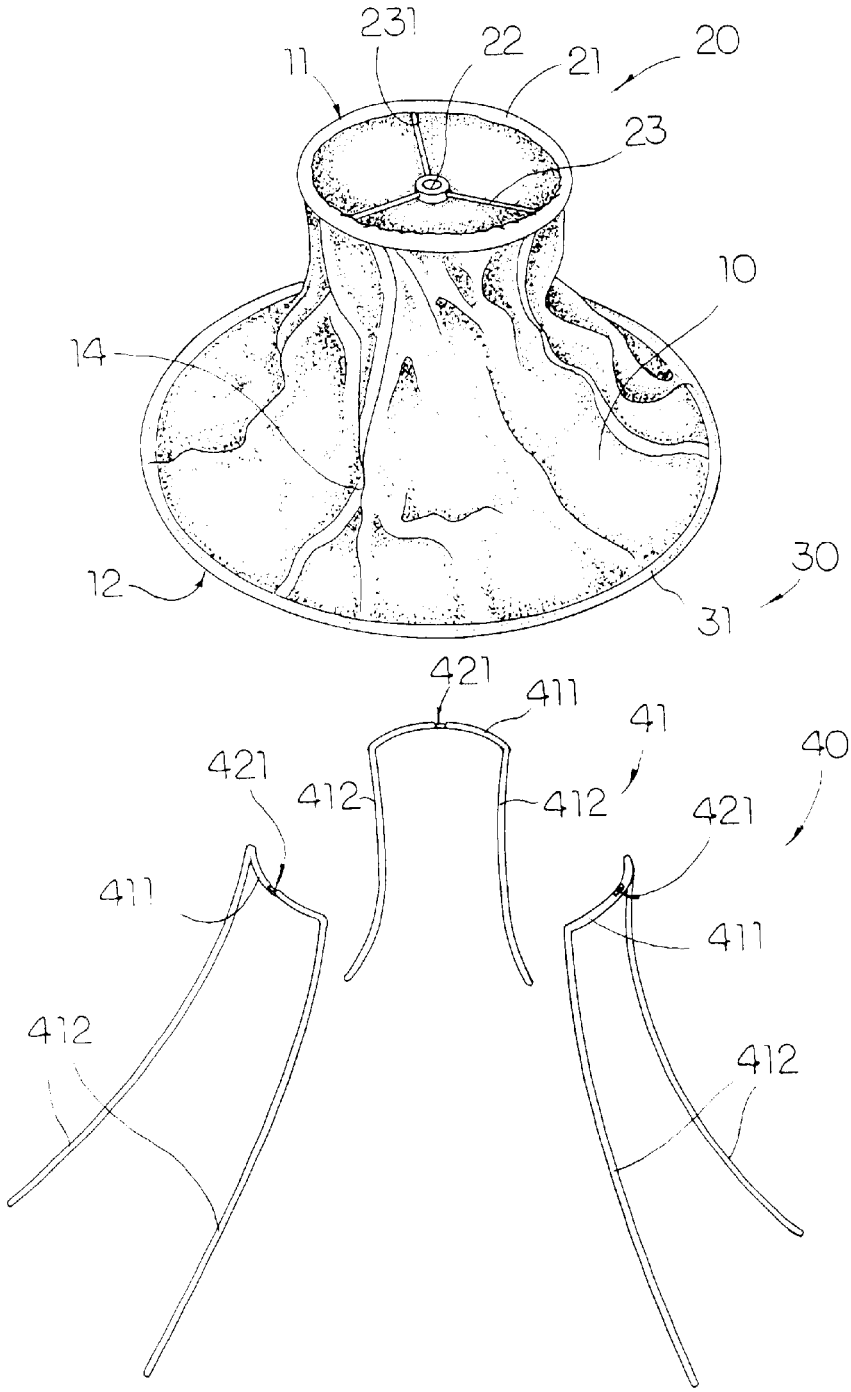
FIG. 2 is an exploded perspective view of the lamp shade assembly according to the above preferred embodiment of the present invention.
Figure 3:
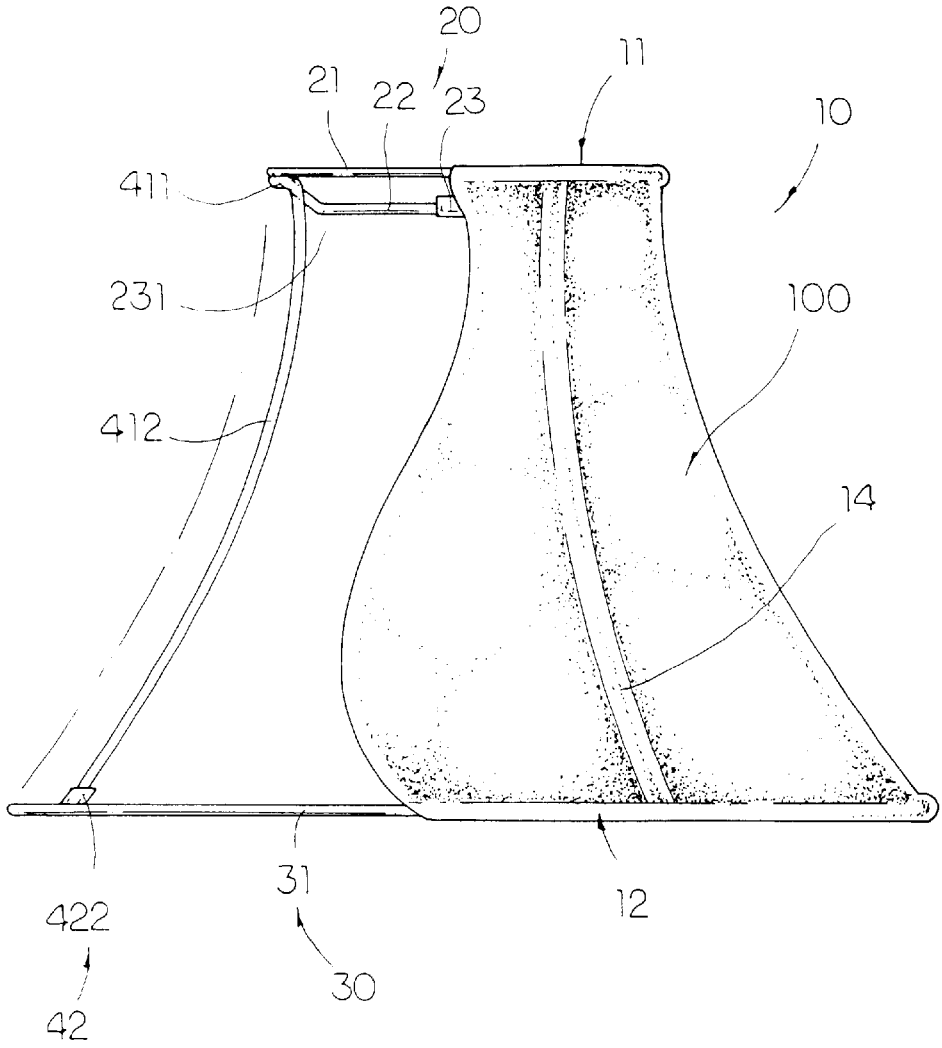
FIG. 3 is a sectional view of the lamp shade assembly according to the above preferred embodiment of the present invention.

Referring to FIGS. 1 to 3 of the drawings, a lamp shade assembly according to a preferred embodiment of the present invention is illustrated, wherein the lamp shade assembly comprises a foldable shade 10 made of foldable material likes fabric, cloth, nylon, PVC, and etc. The foldable shade 10 has an upper edge 11 and a lower edge 12 to define an inner cavity 13 therebetween, a top frame 20 securely mounted at the upper edge 11 of the foldable shade 10, and a bottom frame 30 securely mounted at the lower edge 12 of the foldable shade 10.

The lamp shade assembly further comprises a supporting frame 40 detachably mounted between the top frame 20 and the bottom frame 30 within the inner cavity 13 of the foldable shade 10 for applying a stretching force on the foldable shade 10, wherein the stretching force of the supporting frame 40 is greater than a weight of the foldable shade 10 so that the foldable shade 10 is stretched to provide a tension surface 100 extending between the upper edge 11 and the lower edge 12 thereof so as to form a lamp shade as shown in FIG. 1.

According to the preferred embodiment, the foldable shade 10, having a hollow shape, has two circumferential edges embodied as the upper edge 11 and the lower edge 12 respectively, wherein the foldable shade 10 is made of soft fabric material such as cotton such that when a light source is disposed within the inner cavity 13, the light generated from the light source is adapted to pass through the foldable shade 10 and is softened by the foldable shade 10.

The foldable shade 10 has the weight embodied as a downward force to drop down the upper edge 11 of the foldable shade 10 towards the lower edge 12 thereof by gravity, in such a manner that when the supporting frame 40 is detached from the foldable shade 10, the weight of the foldable shade 10 forces it to fold up, as shown in FIG. 2.

The top frame 20 comprises a boundary frame 21 securely attached to the upper edge 11 of the foldable shade 10, a light source mount 22 adapted for supporting a light source thereon, and at least two guiding arms 23 each extended between the boundary frame 21 and the light source mount 22, so as to support the light source mount 22 at a center of the boundary frame 21.

The bottom frame 30 comprises a surrounding frame 31 securely attached to the lower edge 11 of the foldable shade 10 to retain a shape of the foldable shade 10 at a lower portion thereof.

As shown in FIG. 2, the supporting frame 40 comprises at least two U-shaped supporting arms 41 each having an upper supporting ridge 411 and two reinforcing arms 412 downwardly extended from the supporting ridge 411, and means 42 for detachably mounting the supporting ridge 411 of the supporting arm 41 to the top frame 20 and two bottom ends of the reinforcing arms 412 to the bottom frame 30, so as to tensely support the weight of the foldable shade 10.

The mounting means 42 has a guiding slot 421 formed on the supporting ridge 411 of the supporting arm 41 and comprises a plurality of mounting pockets 422 spacedly provided at the bottom frame 30 in such a manner that the bottom ends of the reinforcing arms 412 are slidably inserted into the mounting pockets 422 respectively while the respective guiding arm 23 of the top frame 20 is slidably engaged with the guiding slot 421 on the supporting ridge 411, as shown in FIG. 3.

A length of the reinforcing arm 412 should be at least equal to a distance between the upper and lower edges 11, 12 of the foldable shade 10, in such a manner that when the supporting arm 41 is mounted between the top and bottom frames 20, 30, the supporting arm 41 is arranged to apply the stretching force on the foldable shade 10 for tensely pulling the top frame 20 away from the bottom frame 30, so as to provide the tension surface 100 of the foldable shade 10. Accordingly, the stretching force applied by the supporting arm 41 must be greater than the weight of the foldable shade 10 while the top frame 20 is mounted thereon to substantially support the foldable shade 10 in a tension manner.

Preferably, each of the reinforcing arms 412 is made rigid but flexible material, such as metal, such that the reinforcing arms 412 can be slightly bent to mount between the top and bottom frames 20, 30 to substantially pull the top frame 20 away from the bottom frame 30 by means of the stretching force.

Accordingly, each of the guiding arms 23 is bent downwardly at an outer end portion thereof to form a locking arc 231 wherein the guiding arm 23 is slidably engaged with the guiding slot 421 on the supporting ridge 411 of the supporting arm 41 until the supporting ridge 411 is slidably passed the locking arc 231 of the guiding arm 23 to mount on the boundary frame 21, so as to securely lock up the supporting arm 41 between the top and bottom frames 20, 30, as shown in FIG. 3.

A distance between the locking arc 231 of the guiding arm 23 and the respective mounting pocket 422 is slightly shorter than a length of the respective reinforcing arm 412 in such a manner that when the guiding arm 23 is slid along the guiding slot 421, a pushing force must be applied on the supporting ridge 411 to slidably pass the locking arc 231 of the guiding arm 23 so as to lock up the supporting ridge 411 with the top frame 20. Therefore, by simply shaping the guiding arms 23, no locking component is required to lock up the supporting arm 41 with the top frame 20.

The mounting pockets 422, each having a hollow shaped, are spacedly formed on the surrounding frame 31 wherein each of the mounting pockets 422 is integrally and upwardly from the surrounding frame 31 of the bottom frame 30 to form a top open end, such that the bottom end of the respective reinforcing arm 412 is fittedly inserted into the mounting pocket 422 so as to securely mount the reinforcing arm 412 on the bottom frame 30.

Alternatively, the mounting pockets 422 can be spacedly formed on the lower edge 12 of the foldable shade 10 by overlappedly stitching the lower edge 12 of the foldable shade 10 to enclose the surrounding frame 31 and to form the mounting pockets 422.

As shown in FIG. 1, the foldable shade 10 further comprises a plurality of reinforcing straps 14 spacedly mounted on the tension surface 100 of the foldable shade 10 wherein each of the reinforcing straps 14 is extended from the upper edge 11 of the foldable shade 10 to the lower edge 12 thereof at a position aligning with the respective reinforcing arm 412. Accordingly, the foldable shade 10 is constructed by connecting a plurality of fabric leaves edges to edges wherein the reinforcing straps 14 are attached on the foldable shade 10 at the connection between each two fabric leaves so that the reinforcing straps 14 are capable of enhancing the strength of the foldable shade 10 to prevent the foldable shade 10 being torn off by the stretching force of the supporting frame 40. In addition, when the light from the light source is passing through the foldable shade 10, the reinforcing arms 412 are hidden behind the reinforcing straps 14 respectively so as to keep the aesthetic appearance of the lamp shade assembly.

Figure 4A:
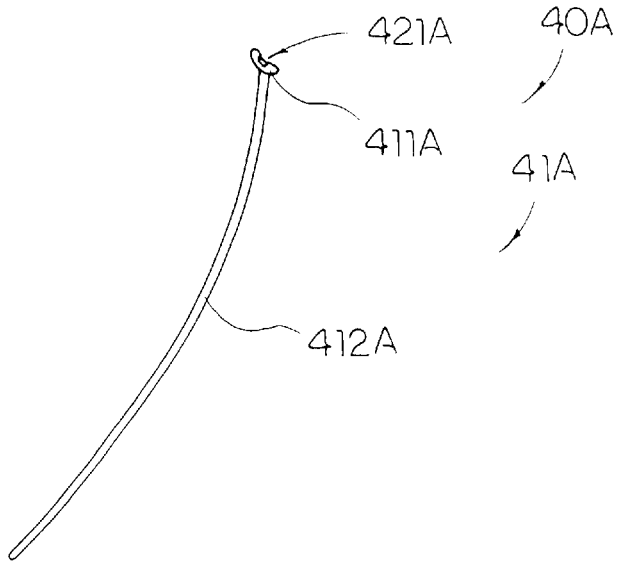
FIGS. 4A and 4B illustrates alternative modes of a supporting frame of the lamp shade assembly according to the above preferred embodiment of the present invention.
Figure 4B:
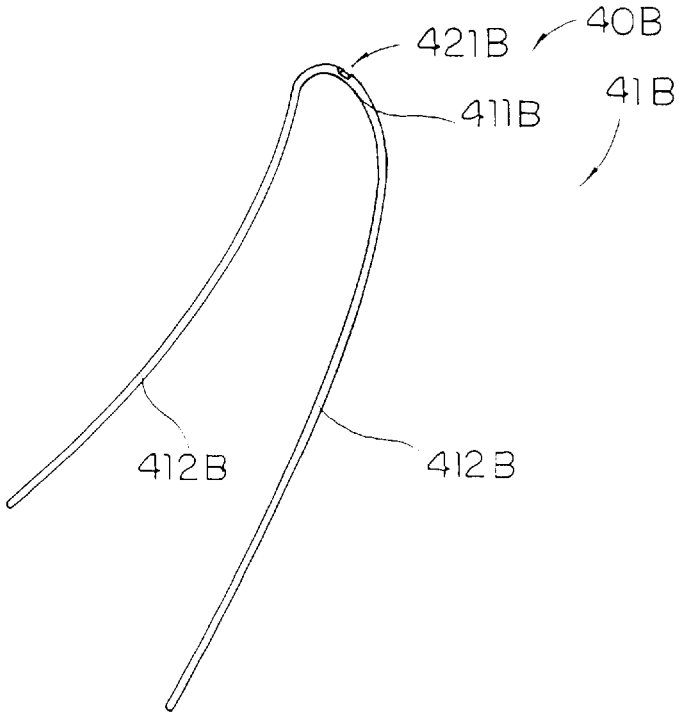

FIGS. 4A and 4B are alternative modes of the supporting frame 40A, 40B to detachably mounted between the top frame 20 and the bottom frame 30 so as to tensely support the foldable shade 10.

As shown in FIG. 4A, the supporting frame 40A comprises at least two T-shaped supporting arms 41A each having an upper supporting ridge 411A and a reinforcing arm 412A downwardly extended from the supporting ridge 441A, wherein the guiding slot 421A is formed on a peak of the supporting ridge 411A of the supporting arm 41A to slidably engage with the guiding arm 23 of the top frame 20.

As shown in FIG. 4B, the supporting frame 40B comprises at least two arc-shaped supporting arms 41B, each having an upper supporting ridge 441B and two reinforcing arms 412B downwardly extended from the supporting ridge 411B, wherein the guiding slot 421B is formed on the supporting ridge 411A of the supporting arm to slidably engage with the guiding arm 23 of the top frame 20.

In order to mount the supporting frame 40 between the top and bottom frames 20, 30, the user is able to simply insert the bottom ends of the reinforcing arms 412 to the mounting pockets 422 respectively. Then, the user is able to align the guiding arm 23 of the top frame 20 with respect to the guiding slot 421 so as to slide the supporting ridge 411 on the respective guiding arm 23. By applying a pushing force on the supporting frame 40, the supporting ridge 411 is forced to slidably pass through the locking arc 231 of the guiding arm 23 and to engage with the boundary frame 21, so as to securely lock up the supporting frame 40 between the top and bottom frames 20, 30 to tensely support the foldable shade 10.

It is worth to mention that when the supporting frame 40 is detached from the top and bottom frames 20, 30, the weight of the foldable shade 10 is dropped down to fold up the foldable shade 10 by minimizing a distance between the top and bottom frames 20, 30, as shown in FIG. 2. Therefore, the lamp shade assembly can be easily folded up to a compact unit for carriage and storage and unfolded to provide the tension surface 100 of the foldable shade 10.

What is claimed is:

1. A lamp shade assembly, comprising:

a foldable shade having an upper edge and a lower edge to define an inner cavity therebetween and comprising a plurality of reinforcing straps;

a top frame mounted at said upper edge of said foldable shade;

a bottom frame mounted at said lower edge of said foldable shade; and a supporting frame detachably mounted between said top frame and said bottom frame within said inner cavity of said foldable shade for applying a stretching force on said foldable shade, wherein said stretching force of said supporting frame is greater than a weight of said foldable shade and thus said foldable shade is stretched to provide a tension surface extending between said upper edge and said lower edge thereof; wherein said supporting frame comprises at least two U-shaped supporting arms each having an upper supporting ridge and two reinforcing arms downwardly extended from said supporting ridge, and means for detachably mounting said supporting ridges of said supporting arms to said top frame and bottom ends of said reinforcing arms to said bottom frame, so as to tensely support said weight of said foldable shade, wherein said reinforcing straps are spacedly mounted on said tension surface of said foldable shade wherein each of said reinforcing straps is extended from said upper edge of said foldable shade to said lower edge thereof at a position aligning with said respective reinforcing arm.

2. A lamp shade assembly, comprising:

a foldable shade having an upper edge and a lower edge to define an inner cavity therebetween and comprising a plurality of reinforcing straps;

a top frame mounted at said upper edge of said foldable shade, wherein said top frame comprises a boundary frame securely attached to said upper edge of said foldable shade, a light source mount adapted for supporting a light source thereon, and at least two guiding arms each extended between said boundary frame and said light source mount, so as to support said light source mount at a center of said boundary frame;

a bottom frame mounted at said lower edge of said foldable shade; and a supporting frame detachably mounted between said top frame and said bottom frame within said inner cavity of said foldable shade for applying a stretching force on said foldable shade, wherein said stretching force of said supporting frame is greater than a weight of said foldable shade and thus said foldable shade is stretched to provide a tension surface extending between said upper edge and said lower edge thereof, wherein said supporting frame comprises at least two U-shaped supporting arms each having an upper supporting ridge and two reinforcing arms downwardly extended from said supporting ridge, and means for detachably mounting said supporting ridge of said supporting arm to said top frame and two bottom ends of said reinforcing arms to said bottom frame, so as to tensely support said weight of said foldable shade, wherein said mounting means has a guiding slot formed on said supporting ridge of each said supporting arm and comprises at least two mounting pockets spacedly provided at said bottom frame in such a manner that said bottom ends of said reinforcing arms are slidably inserted into said mounting pockets respectively while said respective guiding arm of said top frame is slidably engaged with said guiding slot on said supporting ridge, wherein said reinforcing straps are spacedly mounted on said tension surface of said foldable shade wherein each of said reinforcing straps is extended from said upper edge of said foldable shade to said lower edge thereof at a position aligning with said respective reinforcing arm.

3. A lamp shade assembly, comprising:

a foldable shade having an upper edge and a lower edge to define an inner cavity therebetween and comprising a plurality of reinforcing straps;

a top frame mounted at said upper edge of said foldable shade, wherein said top frame comprises a boundary frame securely attached to said upper edge of said foldable shade, a light source adapted for supporting a light source thereon, and at least two guiding arms each extended between said boundary frame and said light source mount, so as to support said light source mount at a center of said boundary frame;

a bottom frame mounted at said lower edge of said foldable shade; and a supporting frame detachably mounted between said top frame and said bottom frame within said inner cavity of said foldable shade for applying a stretching force on said foldable shade, wherein said stretching force of said supporting frame is greater than a weight of said foldable shade and thus said foldable shade is stretched to provide a tension surface extending between said upper edge and said lower edge thereof, wherein said supporting frame comprises at least two U-shaped supporting arms each having an upper supporting ridge and two reinforcing arms downwardly extended from said supporting ridge, and means for detachably mounting said supporting ridge of said supporting arm to said top frame and two bottom ends of said reinforcing arms to said bottom frame, so as to tensely support said weight of said foldable shade, wherein said mounting means has a guiding slot formed on said supporting ridge of said each supporting arm and comprises at least two mounting pockets spacedly provided at said bottom frame in such a manner that said bottom ends of said reinforcing arms are slidably inserted into said mounting pockets respectively while said respective guiding arm of said top frame is slidably engaged with said guiding slot on said supporting ridge, wherein each of said guiding arms is bent downwardly at an outer end portion thereof to form a locking arc wherein said supporting ridge is slidably passed said locking arc of said guiding arm to mount on said boundary frame, so as to securely lock up said supporting arm between said top and bottom frames, wherein said reinforcing straps are spacedly mounted on said tension surface of said foldable shade wherein each of said reinforcing straps is extended from said upper edge of said foldable shade to said lower edge thereof at a position aligning with said respective reinforcing arm.

4. A lamp shade assembly, comprising:

a foldable shade having an upper edge and a lower edge to define an inner cavity therebetween;

a top frame mounted at said upper edge of said foldable shade, wherein said top frame comprises a boundary frame securely attached to said upper edge of said foldable shade, a light source adapted for supporting a light source thereon, and at least two guiding arms each extended between said boundary frame and said light source mount, so as to support said light source mount at a center of said boundary frame;

a bottom frame mounted at said lower edge of said foldable shade; and a supporting frame detachably mounted between said top frame and said bottom frame within said inner cavity of said foldable shade for applying a stretching force on said foldable shade, wherein said stretching force of said supporting frame is greater than a weight of said foldable shade and thus said foldable shade is stretched to provide a tension surface extending between said upper edge and said lower edge thereof, wherein said supporting frame comprises at least two T-shaped supporting arms each having an upper supporting ridge and a reinforcing arm downwardly extended from said supporting ridge, and means for detachably mounting said supporting ridges of said supporting arms to said top frame and bottom ends of said reinforcing arms to said bottom frame, so as to tensely support said weight of said foldable shade, wherein said mounting means has a guiding slot formed on said supporting ridge of said each supporting arm and comprises at least two mounting pockets spacedly provided at said bottom frame in such a manner that said bottom ends of said reinforcing arms are slidably inserted into said mounting pockets respectively while said respective guiding arm of said top frame is slidably engaged with said guiding slot on said supporting ridge.

5. A lamp shade assembly, as recited in claim 4, wherein each of said guiding arms is bent downwardly at an outer end portion thereof to form a locking arc wherein said supporting ridge is slidably passed said locking arc of said guiding arm to mount on said boundary frame, so as to securely lock up said supporting arm between said top and bottom frames.

6. A lamp shade assembly, as recited in claim 5, wherein said foldable shade further comprises a plurality of reinforcing straps spacedly mounted on said tension surface of said foldable shade wherein each of said reinforcing straps is extended from said upper edge of said foldable shade to said lower edge thereof at a position aligning with said respective reinforcing arm.

7. A lamp shade assembly, comprising:

a foldable shade having an upper edge and a lower edge to define an inner cavity therebetween and comprising a plurality of reinforcing straps;

a top frame mounted at said upper edge of said foldable shade, wherein said top frame comprises a boundary frame securely attached to said upper edge of said foldable shade, a light source adapted for supporting a light source thereon, and at least two guiding arms each extended between said boundary frame and said light source mount, so as to support said light source mount at a center of said boundary frame;

a bottom frame mounted at said lower edge of said foldable shade; and a supporting frame detachably mounted between said top frame and said bottom frame within said inner cavity of said foldable shade for applying a stretching force on said foldable shade, wherein said stretching force of said supporting frame is greater than a weight of said foldable shade and thus said foldable shade is stretched to provide a tension surface extending between said upper edge and said lower edge thereof, wherein said supporting frame comprises at least two arc-shaped supporting arms each having an upper supporting ridge and two reinforcing arms downwardly extended from said supporting ridge, and means for detachably mounting said supporting ridges of said supporting arms to said top frame and bottom ends of said reinforcing arms to said bottom frame, so as to tensely support said weight of said foldable shade, wherein said mounting means has a guiding slot formed on a peak of said supporting ridge of said each supporting arm and comprises at least two mounting pockets spacedly provided at said bottom frame in such a manner that said bottom ends of said reinforcing arms are slidably inserted into said mounting pockets respectively while said respective guiding arm of said top frame is slidably engaged with said guiding slot on said supporting ridge, wherein each of said guiding arms is bent downwardly at an outer end portion thereof to form a locking arc wherein said supporting ridge is slidably passed said locking arc of said guiding arm to mount on said boundary frame, so as to securely lock up said supporting arm between said top and bottom frames, wherein said reinforcing straps are spacedly mounted on said tension surface of said foldable shade wherein each of said reinforcing straps is extended from said upper edge of said foldable shade to said lower edge thereof at a position aligning with said respective reinforcing arm.

* * * * *